US010024174B2

(12) United States Patent
Yoshinari et al.

(10) Patent No.: US 10,024,174 B2
(45) Date of Patent: Jul. 17, 2018

(54) NI-BASED CASTING SUPERALLOY AND CAST ARTICLE THEREFROM

(71) Applicant: MITSUBISHI HITACHI POWER SYSTEMS, LTD., Yokohama, Kanagawa (JP)

(72) Inventors: Akira Yoshinari, Yokohama (JP); Yuting Wang, Yokohama (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 598 days.

(21) Appl. No.: 14/553,045

(22) Filed: Nov. 25, 2014

(65) Prior Publication Data

US 2015/0147226 A1 May 28, 2015

(30) Foreign Application Priority Data

Nov. 25, 2013 (JP) ..... 2013-242529

(51) Int. Cl.

*C22C 19/05* (2006.01)
*F01D 5/28* (2006.01)
*C22C 1/02* (2006.01)

(52) U.S. Cl.

CPC ..... *F01D 5/286* (2013.01); *C22C 1/02* (2013.01); *C22C 19/056* (2013.01); *C22C 19/057* (2013.01); *F05D 2230/21* (2013.01); *F05D 2300/175* (2013.01); *F05D 2300/177* (2013.01); *F05D 2300/607* (2013.01); *F05D 2300/609* (2013.01)

(58) Field of Classification Search

CPC ..... C22C 19/056; C22C 19/057; C22F 1/10
See application file for complete search history.

(56) References Cited

U.S. PATENT DOCUMENTS

| | | | |
|---|---|---|---|
| 4,643,782 | A | 2/1987 | Harris et al. |
| 4,719,080 | A | 1/1988 | Duhl et al. |
| 5,069,873 | A | 12/1991 | Harris et al. |
| 5,173,255 | A | 12/1992 | Ross et al. |
| 6,051,083 | A | 4/2000 | Tamaki et al. |
| 8,226,886 | B2 | 7/2012 | Hanlon et al. |

(Continued)

FOREIGN PATENT DOCUMENTS

| | | |
|---|---|---|
| EP | 1 332 824 A2 | 8/2003 |
| EP | 1 536 026 A1 | 6/2005 |

(Continued)

OTHER PUBLICATIONS

European Search Report dated Apr. 20, 2015 (five (5) pages).

*Primary Examiner* — Jessee Roe
(74) *Attorney, Agent, or Firm* — Crowell & Moring LLP

(57) ABSTRACT

It is an objective of the invention to provide a low cost Ni-based casting superalloy suitable for casting articles having a far better balance among a high-temperature mechanical strength, a grain boundary strength and a oxidation resistance than conventional Ni-based superalloy cast articles. There is provided an Ni-base casting super alloy including: in mass %, 0.03 to 0.15% of C; 0.005 to 0.04% of B; 0.01 to 1% of Hf; 0.05% or less of Zr; 3.5 to 4.9% of Al; 4.4 to 8% of Ta; 2.6 to 3.9% of Ti; 0.05 to 1% of Nb; 8 to 12% of Cr; 1 to 6.9% of Co; 4 to 10% of W; 0.1 to 0.95% of Mo; 0.02 to 1.1% of Si and/or 0.1 to 3% of Fe; and the balance including Ni and incidental impurities.

11 Claims, 2 Drawing Sheets

(56) References Cited

U.S. PATENT DOCUMENTS

| | | | |
|---|---|---|---|
| 2004/0229072 | A1 | 11/2004 | Murphy |
| 2007/0071607 | A1 | 3/2007 | Esser |
| 2011/0052443 | A1 | 3/2011 | Hanlon et al. |

FOREIGN PATENT DOCUMENTS

| | | | | |
|---|---|---|---|---|
| GB | 2105748 | A1 * | 3/1983 | ..... C22C 19/05 |
| GB | 2 234 521 | A | 2/1991 | |
| GB | 2 235 697 | A | 3/1991 | |
| JP | 60-211031 | A | 10/1985 | |
| JP | 61-284545 | A | 12/1986 | |
| JP | 2-153037 | A | 6/1990 | |
| JP | 3-97822 | A | 4/1991 | |
| JP | 5-59473 | A | 3/1993 | |
| JP | 5-59474 | A | 3/1993 | |
| JP | 9-272933 | A | 10/1997 | |
| JP | 2004-197216 | A | 7/2004 | |

* cited by examiner

NI-BASED CASTING SUPERALLOY AND CAST ARTICLE THEREFROM

CLAIM OF PRIORITY

The present application claims priority from Japanese patent application serial no. 2013-242529 filed on Nov. 25, 2013, the content of which is hereby incorporated by reference into this application.

BACKGROUND OF THE INVENTION

1. Field of the Invention

The present invention relates to Ni (nickel)-based casting superalloys, and particularly to an Ni-based casting superalloy suitable for a cast article having an excellent high-temperature mechanical strength and an excellent high-temperature oxidation resistance and advantageously used for large size high-temperature components (such gas turbine blades) exposed to high temperature. The invention also particularly relates to a cast article from such an Ni-based casting superalloy of the invention.

2. Description of Related Art

An effective way to increase the efficiency of turbine power generators used in coal fired power plants or gas turbine power generation plants is to increase the main steam temperature in the boiler used in such a coal fired power plant or the combustion gas temperature in the gas turbine used in such a gas turbine power generation plant. For example, in recent years, there have been continued efforts to further increase the temperature of the combustion gas used for gas turbine power generators in order to further enhance the efficiency of the gas turbine power generator. In order to withstand such high temperature, high temperature components used in gas turbines are required to have a higher oxidation resistance and a greater high-temperature mechanical strength than conventional components.

Among high-temperature components used in gas turbines, gas turbine blades (rotor blades and vanes) are exposed to the severest operating environment. In order to withstand such a very severe operating environment (such as high temperature), columnar grain Ni-based superalloys (almost entirely consisting of columnar grains), which have a high-temperature mechanical strength greater than conventional Ni-based superalloys (having a conventionally obtained cast structure), have been beginning to be used for such high-temperature turbine blades. Furthermore, for aircraft engine gas turbines and some power generation gas turbines, single crystal Ni-based superalloys (almost entirely consisting of a single crystal), which have a high-temperature mechanical strength further higher than columnar grain Ni-based superalloys, are beginning to be used. As described above, single crystal Ni-based superalloys have the greatest high-temperature mechanical strength. For example, CMSX-4® (see, e.g., JP 1985-211031 A), PWA-1484 (see, e.g., JP 1986-284545 A) and Rene' N5 (see, e.g., JP 1993-059474 A) have been developed as such an Ni-based superalloy for casting single crystal components and applied to aircraft engine gas turbines.

Beside single crystal Ni-based superalloys, columnar grain Ni-based superalloys having a further improved mechanical strength are also promising. Typical ways to increase the mechanical strength of columnar grain Ni-based superalloys include: precipitation strengthening which involves dispersing fine γ' (gamma prime)-phase precipitates (typically an $Ni_3Al$ phase in which an Al (aluminum) site thereof is sometimes substituted by Ti (titanium), Nb (niobium) or Ta (tantalum)) in a γ-phase (Ni-based solid solution phase) matrix; solid solution strengthening which involves dissolving a solid solution strengthening element (such as Cr (chromium), Co (cobalt), Mo (molybdenum) and W (tungsten)) in the γ-phase matrix to form a solid solution; and grain boundary strengthening which involves adding a grain boundary strengthening element (such as C (carbon), B (boron), Zr (zirconium) and Hf (hafnium)). The precipitation strengthening by γ'-phases and the solid solution strengthening of the γ-phase are effective also for single crystal superalloys. However, an element for suppressing coarsening of the γ-phase matrix grains and a grain boundary strengthening element are not intentionally added to single crystal superalloys because single crystal superalloys do not actively contain any plural crystal grains or any grain boundaries.

Casting a single crystal Ni-based superalloy article is very delicate. During the single crystal growth, an undesirable crystal grain having a growth orientation angle different from the desirable orientation angle may sometimes grow due to an accidental temperature fluctuation or presence of an undesirable impurity. Hereinafter, such a grain having an undesirable growth orientation angle is referred to as a "misoriented grain" and such an undesirable growth orientation angle is referred to as a "misorientation angle". A problem here is that presence of such a misoriented grain (and therefore presence of a grain boundary) significantly degrades a mechanical strength of the single crystal cast article because no grain boundary strengthening element is intentionally added to conventional Ni-based superalloys for casting single crystal articles. For example, when a single crystal cast article contains a misoriented grain having a misorientation angle equal to or more than 5°, the mechanical strength of the single crystal cast article drastically decreases. In the worst case scenario, during the casting operation, a solidification crack may occur along a grain boundary generated by the misoriented grain.

In order to alleviate this problem, Ni-based superalloys for casting single crystal articles containing an intentionally added grain boundary strengthening element have been developed (see, e.g., JP 1993-059473 A). However, even using such a method, the misorientation angle is limited to less than about 15° in order to assure sufficient grain boundary strength; thus, the above misoriented grain problem cannot be fully solved.

In order to take full advantages of single crystal gas turbine blades, the blade needs to be almost entirely single crystalline (or at least must not contain any misoriented grains whose orientation angle exceeds an allowable misorientation angle).

Herein, a total length of aircraft engine gas turbine blades is usually about 100 mm. During the casting of such a relatively small component, the tendency of any misoriented grain to grow is relatively small. Therefore, single crystal aircraft engine gas turbine blades can be industrially manufactured at a sufficiently high yield. In contrast, a total length of power generation gas turbine blades is as long as about 150 to 450 mm. Such a large blade is very difficult to cast in a single crystal. Therefore, single crystal power generation gas turbine blades previously could not be manufactured at an industrially acceptable yield (i.e., at a low cost).

Because of the above problem, currently, large-size high-temperature components such as power generation gas turbine blades are usually cast to have a columnar grain crystal structure by a directional solidification method. For example, CM186LC (see, e.g., JP 1991-097822 A), Rene' 142 (see, e.g., JP 1992-153037 A) have been developed as such an Ni-based superalloy for casting columnar grain articles. According to the above disclosures, the disclosed Ni-based superalloys for casting columnar grain articles contain grain boundary strengthening elements in order to increase the bonding strengths between neighboring columnar grains, and the articles cast from the Ni-based superalloys have a high-temperature mechanical strength comparable to those of single crystal Ni-based superalloy articles.

However, even the above-described improved columnar grain Ni-based superalloy gas turbine blades have become unable to sufficiently overcome the above problem. This is because as the combustion gas temperature has been increased, the oxidation has accelerated and the thermal stress has increased, which may potentially cause a vertical crack along a columnar grain boundary.

In order to further increase the grain-to-grain bonding strength (grain boundary strength) and overall high-temperature mechanical strengths of columnar grain Ni-based superalloy articles, various techniques have been researched and developed. For example, JP 1997-272933 A discloses an Ni-based superalloy for directional solidification, the superalloy including: 0.03 to 0.20 wt. % of C; 0.004 to 0.05 wt. % of B; 1.5 wt. % or less of Hf; 0.02 wt. % or less of Zr; 1.5 to 16 wt. % of Cr; 6 wt. % or less of Mo; 2 to 12 wt. % of W; 0.1 to 9 wt. % of Re (rhenium); 2 to 12 wt. % of Ta; 4.0 wt. % or less of Nb; 4.0 to 6.5 wt. % of Al; less than 0.4 wt. % of Ti; 9 wt. % or less of Co; and 60 wt. % or more of Ni. According to this JP 1997-272933 A, the article cast from the Ni-based superalloy by a directional solidification method does not suffer any solidification cracks during the solidification, has a sufficient grain boundary strength to ensure reliability in actual use and has a great high-temperature mechanical strength.

JP 2004-197216 A discloses an Ni-based superalloy including: about 3 to about 12 wt. % of Cr; about 15 wt. % or less of Co; about 3 wt. % or less of Mo; about 3 to about 10 wt. % of W; about 6 wt. % or less of Re; about 5 to about 7 wt. % of Al; about 2 wt. % or less of Ti; about 1 wt. % or less of Fe (iron); about 2 wt. % or less of Nb; about 3 to about 12 wt. % of Ta; about 0.07 wt. % or less of C; about 0.030 to about 0.80 wt. % of Hf; about 0.10 wt. % or less of Zr; about 0.02 wt. % or less of B; about 0.0005 to about 0.050 wt. % of rare earth elements; and the balance practically Ni and inevitable impurities. According to this JP 2004-197216 A, articles cast from the Ni-based superalloy have a high oxidation resistance.

As described above, in recent years, there have been continued efforts to further increase the temperature of the combustion gas used for gas turbine power generators in order to further enhance the efficiency of the gas turbine power generator. In order to increase the combustion gas temperature, there are needed at least large-size high temperature components (such as turbine blades) that can withstand such higher-than-conventional combustion gas temperatures. Accordingly, a strong need exists for further improvement over current Ni-based superalloys (e.g., the ones disclosed in the aforementioned JP 1997-272933 A and JP 2004-197216 A). More specifically, there is needed for an Ni-based superalloy providing a far better balance among a great high-temperature mechanical strength, a high grain boundary strength and a high oxidation resistance than conventional ones.

As another problem, the Ni-based superalloys disclosed in the above JP 1997-272933 A and JP 2004-197216 A contain costly Re and/or rare earth elements. Low cost is an essential requirement for industrial products.

SUMMARY OF THE INVENTION

It is an objective of the present invention to provide a low cost Ni-based casting superalloy suitable for casting articles having a far better balance among a great high-temperature mechanical strength, a high grain boundary strength and a high oxidation resistance than conventional Ni-based superalloy cast articles. Another objective is to provide a cast article from such an Ni-based casting superalloy of the invention.

(I) According to one aspect of the present invention, there is provided an Ni-base casting superalloy including: 0.03 to 0.15 mass % of C (carbon); 0.005 to 0.04 mass % of B (boron); 0.01 to 1 mass % of Hf (hafnium); 0.05 mass % or less of Zr (zirconium); 3.5 to 4.9 mass % of Al (aluminum); 4.4 to 8 mass % of Ta (tantalum); 2.6 to 3.9 mass % of Ti (titanium); 0.05 to 1 mass % of Nb (niobium); 8 to 12 mass % of Cr (chromium); 1 to 6.9 mass % of Co (cobalt); 4 to 10 mass % of W (tungsten); 0.1 to 0.95 mass % of Mo (molybdenum); 0.02 to 1.1 mass % of Si (silicon) and/or 0.1 to 3 mass % of Fe (iron); and the balance including Ni (nickel) and incidental impurities.

In the above aspect (I) of the invention, the following modifications and changes can be made.

i) Content of the Si is more than 0.4 mass % and total content of the Al, the Ti and the Si is 8.8 mass % or less.

ii) Content of the Fe is 1 mass % or more and total content of the Co and the Fe is from 2 mass % to 6.9 mass %.

iii) Content of the Co is from 1 mass % to 4.9 mass % and content of the Mo is from 0.1 mass % to 0.45 mass %.

(II) According to another aspect of the present invention, there is provided an article cast from the Ni-based casting superalloy according to the above aspect of the invention.

In the above aspect (II) of the invention, the following modifications and changes can be made.

iv) The article has a matrix consisting entirely of columnar grains, entirely of a single crystal, or partially of columnar grains and partially of a single crystal.

v) The article is a turbine blade.

ADVANTAGES OF THE INVENTION

According to the present invention, it is possible to provide a low cost Ni-based casting superalloy suitable for casting articles having a far better balance among a great high-temperature mechanical strength, a high grain boundary strength and a high oxidation resistance than conventional Ni-based superalloy cast articles. Also possible is to provide an article cast from the invention's Ni-based casting superalloy (in particular, a columnar grain or single crystal article directionally solidified from the invention's Ni-based casting superalloy), in which the cast article, even when the cast article is large (for example, equal to or larger than 150 mm in total length), does not suffer any solidification cracks during the casting and have such excellent mechanical properties (a great high-temperature mechanical strength, a high grain boundary strength and a high oxidation resistance) as to withstand higher-than-conventional operating temperatures.

Figure 1:
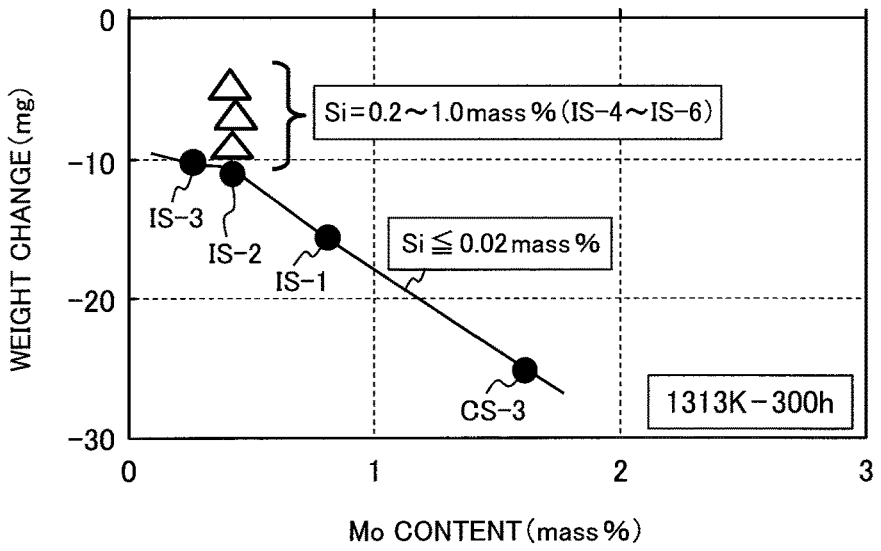
FIG. 1 is a graph showing a relationship between mass change and Mo content of an Ni-based casting superalloy obtained by an oxidation test.

DETAILED DESCRIPTION OF THE PREFERRED EMBODIMENTS (Basic Idea of the Present Invention)

In order to maximize the precipitation strengthening effect of Ni-based superalloys, it is generally desirable to increase the amount of dispersed γ'-phase precipitates and to suppress the additions of such elements that lower the solidus temperature of the γ-phase (at which the γ-phase starts to melt). The reason why a higher solidus temperature of the γ-phase is desirable is as follows: In solution and aging heat treatments for dispersing γ'-phase precipitates, the solution heat treatment is performed at a highest possible temperature lower than the solidus temperature of the γ-phase and not lower than the dissolution temperature of γ'-phases (at which the γ'-phases are completely dissolved in the γ-phase matrix to form solid solutions) in order to enhance the dispersion of fine γ'-phase precipitates at the aging heat treatment stage.

Unfortunately, grain boundary strengthening elements for increasing the grain boundary strength of an Ni-based superalloy and oxidation suppressing elements for increasing the oxidation resistance of the superalloy generally lower the solidus temperature of the γ-phase of the superalloy. Also, solid solution strengthening elements, which dissolve in the γ-phase matrix to form a solid solution thereby increasing the high-temperature mechanical strength of an Ni-based superalloy, may increase the dissolution temperature of γ'-phases of the superalloy. Thus, there is a problem in that an addition of a grain boundary strengthening element or a solid solution strengthening element makes difficult the optimization of the dispersion of fine γ'-phase precipitates (i.e., is prone to degrade the precipitation strengthening effect with the γ'-phases). In other words, the high-temperature mechanical strength, grain boundary strength and oxidation resistance of an Ni-based superalloy are generally conflicting to each other.

The present inventors have actively investigated the effect of additions of solid solution strengthening elements, grain boundary strengthening elements and oxidation suppressing elements on the properties of Ni-based superalloys in order to achieve a high-level balance among the above-described conflicting properties (i.e., an excellent balance among a great high-temperature mechanical strength, a high grain boundary strength and a high oxidation resistance). After the investigation, the present inventors have found that there can be provided at a reduced cost an Ni-based casting superalloy suitable for casting a single crystal or columnar grain article having a greatly improved oxidation resistance while maintaining a mechanical strength comparable to those of conventional single crystal articles and a grain boundary strength comparable to those of conventional columnar grain articles by a novel idea. The idea includes: adding C, B and Hf as grain boundary strengthening elements; optimizing the additions of Cr, W and Mo which can work as solid solution strengthening elements; intentionally adding, as oxidation suppressing elements, Si and Fe, which have been conventionally treated as impurities; and reducing the additions of costly and chemically active rare earth elements and costly Re. The present invention is based on this new finding.

The objective of the invention can be attained by an addition of either Si or Fe. Of course, both Si and Fe may be added.

Preferred embodiments of the present invention will be described below with reference to the accompanying drawings. However, the invention is not limited to the specific embodiments described below, but various combinations and modifications are possible without departing from the spirit and scope of the invention.

(Compositions of Nickel-Based Casting Superalloy)

Compositions of nickel-based casting superalloy according to the present invention will be described below.

C Component:

The C is an important element for increasing both the high-temperature mechanical strength and grain boundary strength of an article cast from the superalloy. As the C content increases, the creep rupture strength in the solidification direction of the casting (i.e., the longitudinal direction of the crystal grains of the cast article) tends to decrease, but the creep rupture strength in directions perpendicular to the solidification direction (i.e., the strength in transverse directions of the crystal grains) tends to increase until the C content reaches 0.15 mass %. In order to achieve both a great high-temperature mechanical strength and a high grain boundary strength, the C content is preferably from 0.03 to 0.15 mass %, more preferably from 0.05 to 0.12 mass % and even more preferably from 0.05 to 0.09 mass %. When the C content is less than 0.03 mass %, the creep rupture strength in the solidification direction is high, but the grain boundary strength is low. Therefore, grain boundary cracks cannot be suppressed sufficiently. When the C content is excessive (more than 0.15 mass %), the creep rupture strength is significantly degraded.

B Component:

The B segregates in the grain boundaries, thereby increasing the mechanical strength in the solidification direction (i.e., increasing the high-temperature mechanical strength) as well as increasing the mechanical strength in directions perpendicular to the solidification direction (i.e., increasing the grain boundary strength). In order to achieve both a great high-temperature mechanical strength and a high grain boundary strength, the B content is preferably from 0.005 to 0.04 mass %, more preferably from 0.016 to 0.035 mass % and even more preferably from 0.016 to 0.025 mass %. When the B content is less than 0.005 mass %, the above positive effects cannot be obtained sufficiently. When the B content is excessive (more than 0.04 mass %), the solidus temperature of the γ-phase is significantly lowered and therefore the γ-phase is prone to partially melt during heat treatments, thereby significantly degrading the creep rupture strength.

Hf Component:

A part of the Hf is dissolved in the γ-phase to form a solid solution, and the other part forms an intermetallic compound $Ni_3Hf$ (a γ'-phase). An addition of Hf has an effect of improving both the creep rupture strength and tensile strength of the cast article in directions perpendicular to the solidification direction, without degrading the creep rupture strength in the solidification direction. The Hf addition also suppresses peeling of oxide films formed on a surface of the cast article, thereby increasing the oxidation resistance. The Hf content is preferably from 0.01 to 1 mass %, more preferably from 0.1 to 0.5 mass % and even more preferably from 0.15 to 0.3 mass %. When the Hf content is less than 0.01 mass %, the above positive effects cannot be obtained sufficiently. When the Hf content exceeds 1 mass %, the solidus temperature of the γ-phase is significantly lowered, and therefore the solution heat treatment of γ'-phases cannot be carried out completely. As a result, the creep rupture strength is significantly degraded.

Zr Component:

Part of Zr forms an intermetallic compound $Ni_3Zr$ (a γ'-phase). An excessive addition of Zr significantly lowers the solidus temperature of the γ-phase, and therefore the solution heat treatment of the γ'-phases cannot be completely carried out. As a result, the creep rupture strength is significantly degraded. Accordingly, the Zr content is preferably from 0.05 mass % or less, more preferably from 0.02 mass % or less, and even more preferably comparable to the contents of inevitable impurities (i.e., the Zr is not intentionally added).

Al Component:

The Al is an essential element for forming γ'-phases, which increases the high-temperature mechanical strength of the cast article. The Al also forms an oxide layer ($Al_2O_3$) on a surface of the cast article, thereby increasing the oxidation resistance and corrosion resistance. The Al content is preferably from 3.5 to 4.9 mass %, more preferably from 4 to 4.6 mass % and even more preferably from 4 to 4.5 mass %. When the Al content is less than 3.5 mass %, the above positive effects cannot be obtained sufficiently. When the Al content exceeds 4.9 mass %, the cast article contains, as casted (as solidified), too much γ' eutectic phases to fully dissolve the γ' eutectic phases in the γ-phase to form solid solutions within the limited time of a solution heat treatment of the invention. Unlike γ'-phases that are precipitated by an aging heat treatment of the invention, the γ' eutectic phases may potentially become a creep-related crack initiation point; therefore, it is desirable to suppress such retained eutectic γ' eutectic phases to as small an amount as possible. However, an article cast from the invention's nickel-based casting superalloy has an excellent high-temperature mechanical strength, even when the γ' eutectic phases are retained in a limited amount (i.e., even when the solution heat treatment cannot completely dissolve the γ' eutectic phases in the γ-phase matrix to form solid solutions).

Ta Component:

The Ta is combined with the Al to form γ'-phases, which increases the high-temperature mechanical strength. The Ta content is preferably from 4.4 to 8 mass %, more preferably from 5 to 8 mass % and even more preferably from 6.1 to 8 mass %. When the Ta content is less than 4.4 mass %, the above positive effect cannot be obtained sufficiently. When the Ta content is excessive (more than 8 mass %), the dissolution temperature of the γ'-phases increases; thereby the solution heat treatment of the γ'-phases cannot be fully carried out.

Ti Component:

The Ti is combined with the Al and Ta to form γ'-phases ($Ni_3(Al,Ta,Ti)$), thereby increasing the high-temperature mechanical strength. The Ti also increases the high-temperature corrosion resistance (such as the molten salt corrosion resistance). The Ti content is preferably from 2.6 to 3.9 mass %, more preferably from 3 to 3.9 mass % and even more preferably from 3.4 to 3.6 mass %. When the Ti content is less than 2.6 mass %, the above positive effects cannot be obtained sufficiently. When the Ti content is excessive (more than 3.9 mass %), the oxidation resistance of the article cast from the superalloy is degraded and a brittle η (eta)-phase ($Ni_3Ti$) tends to precipitate.

Nb Components:

The Nb is combined with the Al and Ti to form a γ'-phase ($Ni_3(Al,Nb,Ti)$), thereby increasing the high-temperature mechanical strength. The Nb also increases the high-temperature corrosion resistance. The Nb content is preferably from 0.05 to 1 mass %, more preferably from 0.1 to 0.8 mass % and even more preferably from 0.1 to 0.5 mass %. When the Nb content is less than 0.05 mass %, the above positive effects cannot be obtained sufficiently. When too much Nb (more than 1 mass %) is added to an Ni-based superalloy containing a relatively large amount of Ti (like the Ni-based casting superalloy of the present invention), brittle η-phases tend to precipitate.

Cr Component:

The Cr dissolves in the γ-phase matrix to form a solid solution and forms an oxide layer ($Cr_2O_3$) on the surface of the cast article, thereby increasing the corrosion resistance and the oxidation resistance. The Cr content is preferably from 8 to 12 mass %, more preferably from 9 to 10.9 mass % and even more preferably from 9.5 to 10.9 mass %. When the Cr content is less than 8 mass %, the above positive effects cannot be obtained sufficiently. When the Cr content is excessive (more than 12 mass %), the maximum soluble amount of solid solution strengthening elements (such as the W) in the γ-phase matrix decreases, thereby degrading the solid solution strengthening effect.

Co Component:

The Co is a chemical element very similar in many of its properties to the Ni, and substitutes for a part of the Ni to form a solid solution in the γ-phase, thereby improving the creep rupture strength and corrosion resistance. The Co content is preferably from 1 to 6.9 mass %, more preferably from 1 to 5.9 mass % and even more preferably from 1 to 4.9 mass %. When the Co content is less than 1 mass %, the above positive effects cannot be obtained sufficiently. When the Co content is excessive (more than 6.9 mass %), the amount of γ'-phase precipitation decreases, thereby degrading the high-temperature mechanical strength.

W Component:

The W is dissolved in the γ-phase matrix to form a solid solution, thereby increasing the high-temperature mechanical strength by the solid solution strengthening. The W content is preferably from 4 to 10 mass %, and more preferably from 5 to 8 mass %. When the W content is less than 4 mass %, the above positive effect cannot be obtained sufficiently. When the W content is excessive (more than 10 mass %), acicular precipitates mainly containing the W form, thereby degrading the high-temperature mechanical strength.

Mo Component:

The Mo, like the Cr, increases the corrosion resistance of the cast article. Also, the Mo, like the W, has a solid solution strengthening effect. The Mo content is preferably from 0.1 to 0.95 mass %, more preferably from 0.1 to 0.45 mass % and even more preferably from 0.35 to 0.45 mass %. When the Mo content is less than 0.1 mass %, the above positive effects cannot be obtained sufficiently. When the Mo content is excessive (more than 0.95 mass %), the oxidation resistance in high temperature atmospheres significantly degrades.

Si Component:

Generally speaking, the Si has an effect of improving the oxidation resistance of an article cast from an Ni-based superalloy. The Si can be added to substitute a part of the Al. The Si is combined with the Al and Ti to form γ'-phases. However, the Si changes the lattice constant of the γ'-phases, thereby degrading the creep rupture strength. Because of this disadvantage of degrading the creep rupture strength, the Si has conventionally been treated as an impurity and its addition has been suppressed to below 0.01 mass % in Ni-based superalloys for casting single crystal articles.

However, the present invention has found that by intentionally adding the Si to an Ni-based casting superalloy containing 8 mass % or more of Cr, the oxidation resistance of an article cast from the superalloy can be increased without sacrificing the creep rupture strength. In the case when the Si is intentionally added, the Si content is preferably from 0.02 to 1.1 mass %, more preferably from 0.04 to 1 mass % and even more preferably from 0.1 to 1 mass %. When the Si content is less than 0.02 mass %, the above positive effect cannot be obtained sufficiently. When the Si content is excessive (more than 1.1 mass %), the creep rupture strength degrades.

In addition, when the Si content is increased, the amount of γ'-phase precipitation tends to increase, thereby potentially degrading the ductility of the cast article. Therefore, when the Si addition exceeds 0.4 mass %, it is preferable that the total amount of the Al, Ti and Si is suppressed to 8.8 mass % or less.

Fe Component:

The Fe easily substitutes for the Co in an Ni-based superalloy. Accordingly, an addition of the Fe to an Ni-based superalloy has been conventionally thought to degrade the creep rupture strength of an article cast from the superalloy. Also, the Fe itself has a poor oxidation resistance. Accordingly, an addition of the Fe to an Ni-based superalloy has been conventionally thought to degrade the oxidation resistance of an article cast from the superalloy. Because of these problems, the Fe has conventionally been treated as an impurity and its addition has been suppressed to below 0.02 mass % in Ni-based superalloys for casting single crystal articles.

However, the present invention has found that by intentionally adding the Fe to an Ni-based superalloy containing 8 mass % or more of Cr, the oxidation resistance of an article cast from the superalloy can be increased without sacrificing the creep rupture strength. This is a surprisingly new finding that was made by the present invention for the first time and overturns conventional technological knowledge. In the case when the Fe is intentionally added, the Fe content is preferably from 0.1 to 3 mass %, more preferably from 0.2 to 3 mass % and even more preferably from 0.2 to 2 mass %. When the Fe content is less than 0.1 mass %, the above positive effect cannot be obtained sufficiently. When the Fe content is excessive (more than 3 mass %), the high-temperature mechanical strength degrades.

As already described, the Fe easily substitutes for the Co in an Ni-based superalloy. In view of this property and the above described preferred Co content when added alone, in the case when the Fe is intentionally added, the total content of the Co and Fe is preferably from 1 to 6.9 mass %.

EXAMPLES

The present invention will be described in more detail below by way of examples. However, the invention is not limited to the specific examples below.

(Preparation of Comparative Superalloys 1 to 4 and Inventive Superalloys 1 to 11)

Comparative Superalloys 1 to 4 (CS-1 to CS-4) and Inventive Superalloys 1 to 11 (IS-1 to IS-11) were prepared. The nominal compositions of these superalloys are shown in Tables 1 and 2. Comparative Superalloy 1 (CS-1) is the superalloy CMSX-4® described in the aforementioned JP 1985-211031 A, which is the most famous among commercial Ni-based superalloys for casting single crystal articles. Comparative Superalloy 2 (CS-2) is the superalloy Rene' N5 described in the aforementioned JP 1993-059474 A, which is used to cast some power generation gas turbine rotor blades. Comparative Superalloys 1 and 2 contain, beside main alloying elements, 3 mass % of Re and practically no C, B, Si and Fe, and articles cast from these superalloys have an excellent high-temperature creep rupture strength. Comparative Superalloy 3 (CS-3) is an Ni-based superalloy for casting single crystal articles presented at "Superalloys 1996, Eighth International Symposium". This Comparative Superalloy 3 contains, beside main alloying elements, C and B and practically no Re, Si and Fe, and an article cast from this superalloy has a higher grain boundary strength than articles cast from Comparative Superalloys 1 and 2.

Compared with Comparative Superalloys 1 to 3 (CS-1 to CS-3), Inventive Superalloys 1 to 11 (IS-1 to IS-11) contain a larger amount of B, relatively larger amounts of Ti and Cr, a smaller amount of Co, a relatively smaller amount of Mo, and intentionally added Si and/or Fe. Comparative Superalloy 4 (CS-4) was prepared for the most part according to the invention except that the Si content was out of the range specified by the invention.

TABLE 1

Nominal Compositions of Comparative Superalloys 1 to 4 and Inventive Superalloys 1 to 4 (in mass %).

| | Comparative Superalloy | | | | Inventive Superalloy | | | |
|---|---|---|---|---|---|---|---|---|
| Component | CS-1 | CS-2 | CS-3 | CS-4 | IS-1 | IS-2 | IS-3 | IS-4 |
| C | <0.01 | <0.01 | 0.05 | 0.06 | 0.07 | 0.08 | 0.07 | 0.07 |
| B | <0.01 | <0.01 | 0.004 | 0.025 | 0.02 | 0.018 | 0.025 | 0.017 |
| Hf | 0.10 | 0.20 | 0.18 | 0.29 | 0.25 | 0.28 | 0.30 | 0.22 |
| Zr | <0.01 | <0.01 | <0.05 | <0.05 | <0.05 | <0.05 | <0.05 | <0.05 |
| Al | 5.6 | 6.2 | 4.2 | 4.6 | 4.3 | 4.24 | 4.35 | 4.38 |
| Ta | 6.5 | 7.0 | 4.8 | 6.7 | 6.5 | 6.85 | 6.9 | 7.82 |
| Ti | 1.0 | <0.01 | 3.5 | 3.55 | 3.35 | 3.38 | 3.25 | 3.35 |
| Nb | <0.01 | <0.01 | 0.46 | 0.30 | 0.50 | 0.45 | 0.52 | 0.42 |
| Re | 3.0 | 3.0 | <0.01 | <0.01 | <0.01 | <0.01 | <0.01 | <0.01 |
| Cr | 6.5 | 7.0 | 9.75 | 10.6 | 10 | 10.4 | 10.8 | 9.8 |
| Co | 9.0 | 8.0 | 7.5 | 4.6 | 4.0 | 4.2 | 6.2 | 4.5 |
| W | 6.0 | 5.0 | 6.0 | 6.95 | 6.5 | 6.45 | 6.2 | 6.05 |
| Mo | 0.6 | 2.0 | 1.5 | 0.35 | 0.80 | 0.42 | 0.25 | 0.45 |
| Si | <0.02 | <0.02 | <0.02 | 2.0 | 0.02 | 0.02 | 0.02 | 0.20 |
| Fe | <0.02 | <0.02 | <0.02 | <0.1 | <0.1 | <0.1 | <0.1 | <0.1 |
| Ni | Balance | Balance | Balance | Balance | Balance | Balance | Balance | Balance |

TABLE 2

Nominal Compositions of Inventive Superalloys 5 to 11 (in mass %).

| Component | Inventive Superalloy | | | | | | |
|---|---|---|---|---|---|---|---|
| | IS-5 | IS-6 | IS-7 | IS-8 | IS-9 | IS-10 | IS-11 |
| C | 0.06 | 0.06 | 0.07 | 0.06 | 0.07 | 0.06 | 0.06 |
| B | 0.016 | 0.028 | 0.017 | 0.028 | 0.02 | 0.022 | 0.019 |
| Hf | 0.18 | 0.28 | 0.23 | 0.30 | 0.20 | 0.25 | 0.23 |
| Zr | <0.05 | <0.05 | <0.05 | <0.05 | <0.05 | <0.05 | <0.05 |
| Al | 4.25 | 4.41 | 4.45 | 4.3 | 4.0 | 4.43 | 3.8 |
| Ta | 5.6 | 7.75 | 5.92 | 5.66 | 4.7 | 6.8 | 7.83 |
| Ti | 3.25 | 3.4 | 3.3 | 3.1 | 3.3 | 3.45 | 3.35 |
| Nb | 0.40 | 0.62 | 0.54 | 0.52 | 0.45 | 0.50 | 0.60 |
| Re | <0.01 | <0.01 | <0.01 | <0.01 | <0.01 | <0.01 | <0.01 |
| Cr | 10.3 | 9.5 | 10.8 | 10.2 | 10.4 | 10.5 | 10 |
| Co | 6.0 | 3.8 | 5.1 | 5.7 | 4.0 | 3.5 | 4.5 |
| W | 7.8 | 5.8 | 7.1 | 7.2 | 7.84 | 6.88 | 5.54 |
| Mo | 0.40 | 0.42 | 0.30 | 0.45 | 0.8 | 0.40 | 0.35 |
| Si | 0.50 | 1.0 | 0.03 | 0.02 | <0.02 | <0.02 | <0.02 |
| Fe | <0.1 | <0.1 | 0.2 | 1.0 | 0.1 | 0.1 | 0.1 |
| Ni | Balance | Balance | Balance | Balance | Balance | Balance | Balance |

(Preparation and Evaluation of Single Crystal Ni-Based Superalloy Sample)

Single crystal Ni-based superalloy samples were prepared as follows: First, master ingots having nominal compositions shown in Tables 1 and 2 were prepared in a vacuum induction melting furnace. Next, each master ingot was cast into a single crystal Ni-based superalloy sample bar (15 mm of diameter, 180 mm of length) in a directional solidification furnace. The directional solidification was performed at 1800 K (1527° C.) at a solidification rate of 20 cm/h. Then, each directionally solidified superalloy sample bar was subjected to a solution heat treatment by heating the bar to 1493 K (1220° C.) in 4 hours and maintaining it at this temperature for 2 hours; then further heating the bar to 1513 K (1240° C.) in 10 minutes and maintaining it at this temperature for 2 hours; and then cooling it to room temperature in air. After that, each solution heat treated sample bar was subjected to an aging heat treatment by heating the bar to 1373 K (1100° C.), maintaining it at this temperature for 4 hours and air-cooling it; and then heating the bar again to 1173 K (900° C.), maintaining it at this temperature for 20 hours and air-cooling it. Finally, the heat treated single crystal sample bars were machined into test specimens (CS-1 to CS-4 and IS-1 to IS-11).

Each test specimen was subjected to a creep rupture test and an oxidation test. The creep rupture test was conducted under a stress of 137 MPa at 1313 K. The longer the creep rupture time is, the higher the creep rupture strength is. The oxidation test was conducted by repeating an operation of "heating each oxidation test specimen to 1373 K (1100° C.), maintaining it at this temperature for 20 hours and air-cooling it" until the total maintaining time reached 300 hours. The smaller the mass change is, the higher the oxidation resistance is. The results of the creep rupture test and oxidation test are summarized in Table 3.

TABLE 3

Results of Creep Rupture Test and Oxidation Test.

| Superalloy No. | Si (mass %) | Fe (mass %) | Creep Rupture Test Creep Rupture Time (h) | Oxidation Test Mass Change (mg) |
|---|---|---|---|---|
| CS-1 | <0.02 | <0.02 | 726 | −15.2 |
| CS-2 | <0.02 | <0.02 | 680 | −14.7 |

TABLE 3-continued

Results of Creep Rupture Test and Oxidation Test.

| Superalloy No. | Si (mass %) | Fe (mass %) | Creep Rupture Test Creep Rupture Time (h) | Oxidation Test Mass Change (mg) |
|---|---|---|---|---|
| CS-3 | <0.02 | <0.02 | 450 | −25.1 |
| CS-4 | 2.0 | <0.1 | 301 | −4.0 |
| IS-1 | 0.02 | <0.1 | 554 | −15.5 |
| IS-2 | 0.02 | <0.1 | 543 | −10.9 |
| IS-3 | 0.02 | <0.1 | 603 | −10.1 |
| IS-4 | 0.20 | <0.1 | 522 | −9.4 |
| IS-5 | 0.50 | <0.1 | 500 | −7.4 |
| IS-6 | 1.0 | <0.1 | 470 | −5.2 |
| IS-7 | 0.03 | 0.2 | 501 | −9.6 |
| IS-8 | 0.02 | 1.0 | 504 | −11.7 |
| IS-9 | <0.02 | 0.1 | 611 | −12.5 |
| IS-10 | <0.02 | 0.1 | 495 | −10.3 |
| IS-11 | <0.02 | 0.1 | 550 | −9.1 |

As is apparent from Table 3, Inventive Superalloys IS-1 to IS-11 have a longer creep rupture time (i.e., a higher creep rupture strength) and a smaller mass change (i.e., a higher oxidation resistance) than CS-3 (an Ni-based superalloy for casting single crystal articles having an improved grain boundary strength). Also, all Inventive Superalloys exhibit an oxidation resistance comparable or superior to Comparative Superalloys CS-1 and CS-2 (both of which are an Ni-based superalloy for casting single crystal articles having an improved high-temperature mechanical strength). However, Comparative Superalloy CS-4 exhibits an excellent oxidation resistance but a significantly low high-temperature mechanical strength, because its Si content falls out of the invention's specification range.

As already described, in recent years, there have been continued efforts to further increase the temperature of a combustion gas in gas turbines in order to further enhance the efficiency of the gas turbines. In order to withstand such high temperatures, high temperature components used in gas turbines are required to have a higher oxidation resistance than conventional ones. The invention is directed to develop an Ni-based casting superalloy applicable to turbine blades (in particular rotor blades) exposed to the highest temperature in turbines. In order to achieve this objective, the invention has focused on the Mo and Si contents in Ni-based casting superalloys.

FIG. 1 is a graph showing a relationship between the mass change and the Mo content obtained by the oxidation test. As shown in FIG. 1, Inventive Superalloys IS-1 to IS-6 (containing Si and a relatively small amount of Mo) has a smaller mass change (reduction) caused by oxidation (i.e., a higher oxidation resistance) than CS-3 (a conventional Ni-based superalloy having no Si content and a relatively large Mo content for casting single crystal articles having an improved grain boundary strength). That is, the oxidation resistance increases with decreasing the Mo content and increasing the Si content. In Fe-containing Inventive Superalloys IS-7 to IS-11, the Fe had the same effect as above, which was confirmed by an oxidation test not described herein.

(Preparation and Evaluation of Columnar Grain Superalloy Sample)

Columnar grain Ni-based superalloy samples were prepared as follows: First, master ingots of Comparative Superalloy CS-3 and Inventive Superalloy IS-2 were prepared in a vacuum induction melting furnace. Then, the master ingots were cast into a columnar grain Ni-based superalloy sample plate (100 mm of width, 220 mm of length, 15 mm of thickness) in a directional solidification furnace. The length direction of each columnar grain superalloy plate is the solidification direction. Each columnar grain superalloy plate was solution and aging heat treated. The casting condition and solution-and-aging heat treatment conditions were the same as those used in the above-described preparation of single crystal superalloy sample bars.

A cut surface of each columnar grain superalloy sample plate was etched and observed for the macrostructure (presence or absence of any misoriented grains). The result was that the misorientation angle between some adjacent columnar grains exceeded 15°. That is, Comparative Superalloy sample CS-3 and Inventive Superalloy sample IS-2 contain some misoriented grains.

Each superalloy sample plate was subjected to a tensile test. The tensile test temperatures were room temperature and 773 K (500° C.) and the tensile test directions were the solidification direction and a direction perpendicular to the solidification direction. The tensile test result is shown in Table 4.

TABLE 4

Tensile Test Results.

| Superalloy No. | Tensile Test Direction | Tensile Test Temperature (K) | 0.2% Proof Stress (MPa) | Tensile Strength (MPa) | Elongation at Fracture (%) | Reduction in Area at Fracture (%) |
|---|---|---|---|---|---|---|
| Comparative Superalloy CS-3 | Solidification Direction | Room Temperature | 938 | 1025 | 1.0 | 3.0 |
| | | 773 | 948 | 1033 | 0.6 | 4.5 |
| | Perpendicular to Solidification Direction | Room Temperature | *1) | 814 | 0 | 0 |
| | | 773 | *1) | 762 | 0 | 0 |
| Inventive Superalloy IS-2 | Solidification Direction | Room Temperature | 916 | 1083 | 5.0 | 8.1 |
| | | 773 | 910 | 1113 | 5.8 | 10.5 |
| | Perpendicular to Solidification Direction | Room Temperature | 886 | 975 | 2.1 | 5.1 |
| | | 773 | 903 | 986 | 3.4 | 4.3 |

*1) Fractured before 0.2% proof stress was reached.

As shown in Table 4, the columnar grain superalloy sample of Comparative Superalloy CS-3 has a high tensile strength but a low ductility in the solidification direction. Also, Comparative Superalloy CS-3 fractures before the 0.2% proof stress is reached in a direction perpendicular to the solidification direction, thus having an insufficient grain boundary strength. In other words, when an article cast from CS-3 in a directional solidification furnace contains some misoriented columnar grains caused by the casting, the article cannot be used in severe operating conditions. In contrast, the columnar grain superalloy sample of Inventive Superalloy IS-2 has a higher ductility than CS-3 at all the ductility tests including the high temperature ductility tests. Also, IS-2 has a sufficient 0.2% proof stress and tensile strength even at a high temperature of 773 K.

It is thus confirmed that even when a columnar grain article is cast from the invention's Ni-based casting superalloy, the columnar grain article has a high grain boundary strength even at a high temperature of 773 K. This result strongly suggests that the invention's Ni-based casting superalloy can be applied to large-size components (such as gas turbine blades) used at higher-than-conventional temperatures. As already described, almost perfect single crystal materials have been conventionally needed to withstand high temperatures. However, even when a columnar grain component cast from the invention's Ni-based casting superalloy contains some misoriented grains, the component can withstand such high temperatures, thus leading to a yield increase and therefore a cost reduction.

(Fabrication and Evaluation of Large-Size Turbine Blade)

Figure 2:
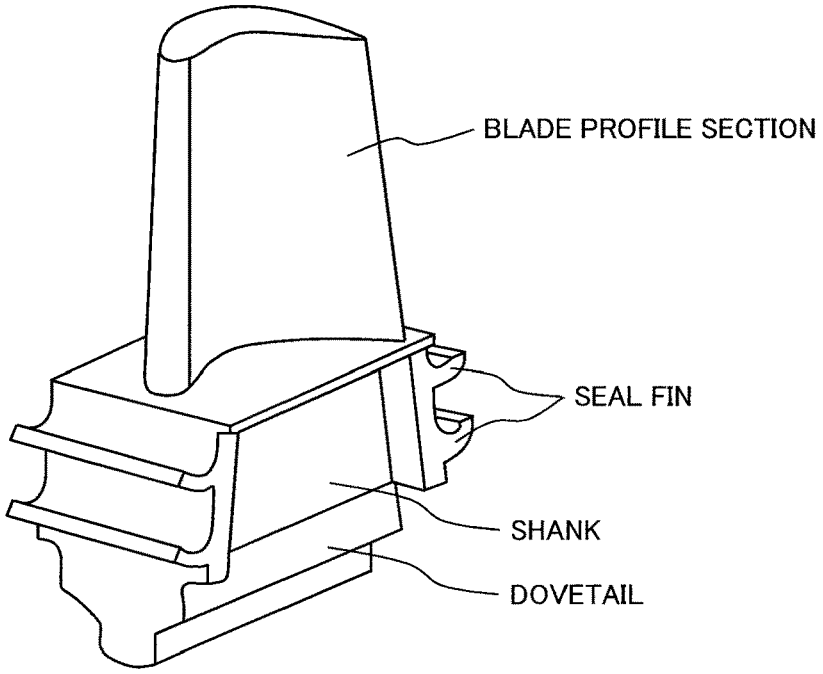
FIG. 2 is a schematic illustration showing a perspective view of an example of a turbine blade according to the present invention.
Figure 3:
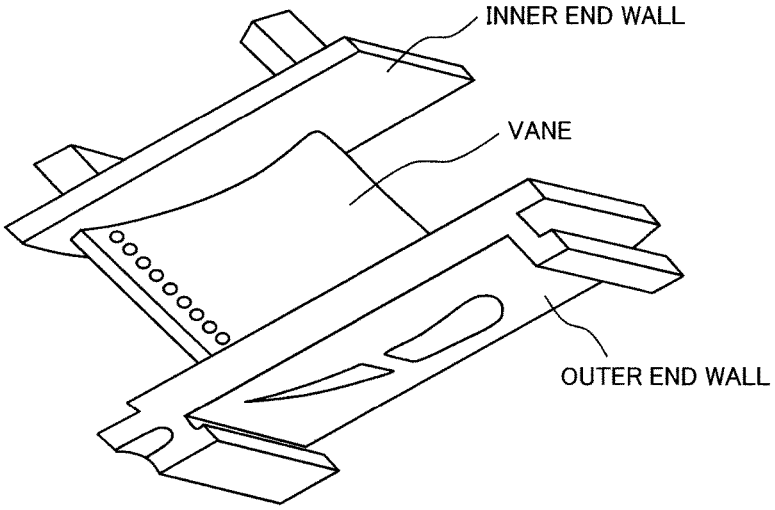
FIG. 3 is a schematic illustration showing a perspective view of an example of a turbine vane (assembly) according to the present invention.

Power generation turbine blades (rotor blades and vanes) were cast from Comparative and Inventive Ni-based casting superalloys. FIG. 2 is a schematic illustration showing a perspective view of an example of a turbine blade according to the invention. FIG. 3 is a schematic illustration showing a perspective view of an example of a turbine vane (assembly) according to the invention. For example, the length of blades (rotor blades and vanes) of a typical 30 MW power generation gas turbine is about 170 mm.

The Ni-based casting superalloys used were the master ingots of Comparative Superalloy CS-3 and Inventive Superalloy IS-2. The rotor blades were cast by directional solidification with a grain selector, and the vanes were cast by directional solidification with a seed. For both castings, the casting temperature was 1800 K (1527° C.) and the solidification rate was 15 cm/h. Four cast samples were prepared for each superalloy and each of the rotor blade and vane. After the casting operation, each cast sample was subjected to solution and aging heat treatments. The solution and aging heat treatment conditions were the same as those used in the above-described preparation of single crystal sample bars.

A cut surface of the rotor blades and vanes was observed for the macrostructure (presence or absence of any misoriented grains). In this observation, the misoriented grain is defined as a grain having a misorientation angle exceeding 15°. The observation results of the macrostructures of the rotor blades are shown in Table 5. The observation results of the macrostructures of the vanes are shown in Table 6.

TABLE 5

Observation Results of Macrostructure of Rotor Blade.

| Sample No. | Superalloy No. | Macro-structure: Blade Profile Section | Shank Section | Seal Fin Section | Dovetail Section | Usability |
|---|---|---|---|---|---|---|
| 1 | CS-3 | Single Crystal | Misoriented Grain | Grain Boundary Crack | Misoriented Grain | Unusable |
| 2 | | | Single Crystal | Misoriented Grain | | |
| 3 | | | Misoriented Grain | Misoriented Grain | | |
| 4 | | | Misoriented Grain | Grain Boundary Crack | | |
| 5 | IS-2 | Single Crystal | Single Crystal | Single Crystal | Misoriented Grain | Usable |
| 6 | | | Single Crystal | Single Crystal | Single Crystal | |
| 7 | | | Misoriented Grain | Misoriented Grain | Misoriented Grain | |
| 8 | | | Single Crystal | Misoriented Grain | Single Crystal | |

TABLE 6

Observation Results of Macrostructure of Vane.

| Sample No. | Superalloy No. | Macro-structure: Inner End Wall: Gas Path Surface | Inner End Wall: Non-Gas Path Surface | Inner End Wall: Vane Section | Outer End Wall: Gas Path Surface | Outer End Wall: Non-Gas Path Surface | Usability |
|---|---|---|---|---|---|---|---|
| 9 | CS-3 | Misoriented Grain | Grain Boundary Crack | Single Crystal | Misoriented Grain | Grain Boundary Crack | Unusable |
| 10 | | Single Crystal | Misoriented Grain | Single Crystal | Single Crystal | Misoriented Grain | Usable |
| 11 | | Misoriented Grain | Misoriented Grain | Grain Boundary Crack | Misoriented Grain | Misoriented Grain | Unusable |
| 12 | | Misoriented Grain | Misoriented Grain | Single Crystal | Misoriented Grain | Grain Boundary Crack | Usable |
| 13 | IS-2 | Misoriented Grain | Misoriented Grain | Single Crystal | Single Crystal | Misoriented Grain | Usable |
| 14 | | Misoriented Grain | | | Single Crystal | | |
| 15 | | Single Crystal | | | Misoriented Grain | | |
| 16 | | Single Crystal | | | Single Crystal | | |

As shown in Table 5, in all of the rotor blade samples cast from CS-3 (Sample Nos. 1 to 4) and the rotor blade samples cast from IS-2 (Sample Nos. 5 to 8), the blade profile section has a single crystal structure without any misoriented grains. However, in some rotor blade samples, the shank and the seal fin sections contain some misoriented grains. Also, in some rotor blade samples cast from CS-3, the seal fin section suffers from a grain boundary crack. Further, in all the samples cast from CS-3 and in some samples cast from IS-2, the dovetail section contains some misoriented grains.

Generally, gas turbine rotor blades are designed in such a way that the temperature rise at the shank and dovetail sections is suppressed to below about 773 K (500° C.) even if the combustion gas temperature increases. Creep does not occur in such a temperature range. Therefore, the usability of the directionally solidified blades is judged based primarily on whether or not the blade has sufficient mechanical properties (such as 0.2% proof stress, tensile strength and elongation at fracture (ductility)) at 773 K.

As shown in Table 4, the columnar grain sample plate cast from CS-3 does not have sufficient mechanical properties at 773 K. As described above, the rotor blades cast from CS-3 has some misoriented grains at the shank, seal fin or dovetail section. Therefore, it is judged that the rotor blades (Sample Nos. 1 to 4) cast from CS-3 cannot be used for actual turbines.

In contrast, as shown in Table 4, the columnar grain sample plate cast from IS-2 have sufficient mechanical properties (such as ductility, 0.2% proof stress and tensile strength) even at 773 K. Therefore, it is judged that the blades (Sample Nos. 5 to 8) cast from IS-2 can be used as an actual gas turbine rotor blade. Thus, if the invention's Ni-based casting superalloy is used to form a gas turbine rotor blade, the shank, dovetail and the like of the rotor blade need not to have a perfect single crystal structure. Therefore, a yield increase (i.e., a cost reduction) can be obtained.

As for the vane (see FIG. 3), the temperature rise at each of end walls (an inner end wall and an outer end wall) is, like the dovetail and the like of the rotor blade, suppressed to a temperature below which creep does not occur. Also, a non-gas path surface of each end wall (the end wall surface opposite the vane section) is not exposed to the combustion gas, and therefore the temperature at the non-gas path surface is much lower than the other parts of the vane. Thus, the non-gas path surfaces of the end walls alone may contain some misoriented grains in conventional vane assemblies. However, the gas path surfaces of the end walls (the end wall surfaces facing the vane section) are required to have sufficient mechanical properties at 773 K at the lowest. In addition, conventionally, the vane section is required to have a single crystal structure.

As shown in Table 6, only one vane sample (Sample No. 10) cast from CS-3 satisfies all of the above-described usability requirements and is judged as "usable". The other three vane samples are judged as "unusable" because the gas path surface of the end walls contain some misoriented grains; or the non-gas path surface of the inner and/or outer end wall or the vane section suffers a grain boundary crack.

By contrast, for all the vane samples (Sample Nos. 13 to 16) cast from IS-2, the vane section has a single crystal structure. For some vane samples cast from IS-2, the gas path surface and/or the non-gas path surface of the both end walls contain misoriented grains. However, all of the vane samples cast from IS-2 are free from any grain boundary crack. As described above by referring to Table 4, the columnar grain sample plate cast from IS-2 have sufficient mechanical properties even at 773 K. Therefore, it is judged that the vanes cast from IS-2 (Sample Nos. 13 to 16) can be used as an actual gas turbine vane. Thus, when the invention's Ni-based casting superalloy is used to form a gas turbine vane, the both end walls (the inner and outer end walls) need not to have a perfect single crystal structure. Therefore, a yield increase (i.e., a cost reduction) can be obtained.

In addition, it is preferable that a turbine rotor blade is directionally solidified in such a manner that the solidification direction is the direction of the centrifugal force acting on the rotor blade. Also, preferably, a turbine vane is directionally solidified in such a manner that the solidification direction is the direction in which the thermal stress is at its maximum.

As has been described, the Ni-based casting superalloy of the invention is suitable for casting articles by directional solidification (e.g., uni-directional solidification). Conventionally, a turbine rotor blade or vane containing misoriented grains cannot be used for actual turbines. However, a turbine rotor blade or vane cast from the invention's Ni-based casting superalloy can be unproblematically used for actual turbines. This leads to a considerable yield increase (and therefore a cost reduction) of large-size high-temperature components. In addition, a high-temperature component cast from the invention's Ni-based casting superalloy has excellent mechanical properties even when the component contains some misoriented grains. Therefore, the reliability of high-temperature components can be greatly enhanced. Accordingly, when high-temperature gas turbine components cast from the invention's Ni-based casting superalloy are used for a power generation gas turbine, the combustion gas temperature of the gas turbine can be increased, and thereby, the power generation efficiency of the power generation gas turbine can be enhanced.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. An Ni-based casting superalloy comprising: 0.03 to 0.15 mass % of C; 0.005 to 0.04 mass % of B; 0.22 to 1 mass % of Hf; 0.05 mass % or less of Zr; 3.5 to 4.9 mass % of Al; 4.4 to 8 mass % of Ta; 2.6 to 3.9 mass % of Ti; 0.05 to 1 mass % of Nb; 8 to 12 mass % of Cr; 1 to 6.9 mass % of Co; 5.54 to 10 mass % of W; 0.1 to 0.95 mass % of Mo; at least one of 0.02 to 1.1 mass % of Si and 0.1 to 3 mass % of Fe; and the balance including Ni and inevitable impurities, wherein content of the Si is more than 0.4 mass % and total content of the Al, the Ti and the Si is 8.8 mass % or less.

2. The Ni-based casting superalloy according to claim 1, wherein content of the Fe is 1 to 3 mass % and total content of the Co and the Fe is from 2 mass % to 6.9 mass %.

3. An article cast from the Ni-based casting superalloy according to claim 2.

4. The article according to claim 3, wherein the article has a matrix consisting entirely of columnar grains, entirely of a single crystal, or partially of columnar grains and partially of a single crystal.

5. The Ni-base casting superalloy according to claim 1, wherein content of the Co is from 1 mass % to 4.9 mass % and content of the Mo is from 1.0 mass % to 0.45 mass %.

6. An article cast from the Ni-based casting superalloy according to claim 5.

7. The article according to claim 6, wherein the article has a matrix consisting entirely of columnar grains, entirely of a single crystal, or partially of columnar grains and partially of a single crystal.

8. An article cast from the Ni-based casting superalloy according to claim 1.

9. The article according to claim 8, wherein the article is a turbine blade.

10. The article according to claim 8, wherein the article has a matrix consisting entirely of columnar grains, entirely of a single crystal, or partially of columnar grains and partially of a single crystal.

11. The article according to claim 10, wherein the article is a turbine blade.

* * * * *